US006802937B2

(12) United States Patent
Johnston et al.

(10) Patent No.: US 6,802,937 B2
(45) Date of Patent: Oct. 12, 2004

(54) EMBOSSED UNCREPED THROUGHDRIED TISSUES

(75) Inventors: Angela Ann Johnston, Hortonville, WI (US); Thomas Allan Eby, Greenville, WI (US); Anne Catherine Paschke, Sister Bay, WI (US); Michael John Smith, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 182 days.

(21) Appl. No.: 10/164,902

(22) Filed: Jun. 7, 2002

(65) Prior Publication Data

US 2003/0228444 A1 Dec. 11, 2003

(51) Int. Cl.[7] ..... D21H 27/02; B31F 1/07

(52) U.S. Cl. ..... 162/117; 162/205; 162/118; 428/156; 428/906

(58) Field of Search ..... 162/109, 117, 162/204–205, 118; 428/153–154, 156, 184, 166, 177, 178, 212, 332, 906, 43

(56) References Cited

U.S. PATENT DOCUMENTS

| | | | | | |
|---|---|---|---|---|---|
| 2,257,428 | A | | 9/1941 | Ruegenberg | |
| RE27,453 | E | | 8/1972 | Schutte et al. | |
| 3,817,827 | A | | 6/1974 | Benz | |
| 4,040,884 | A | | 8/1977 | Roth | |
| 4,153,664 | A | | 5/1979 | Sabee | |
| 4,236,963 | A | | 12/1980 | Busker | |
| 4,543,142 | A | | 9/1985 | Kuepper et al. | |
| 4,759,967 | A | | 7/1988 | Bauernfeind | |
| 5,048,589 | A | | 9/1991 | Cook et al. | |
| 5,180,471 | A | * | 1/1993 | Sauer et al. | 162/112 |
| 5,356,364 | A | | 10/1994 | Veith et al. | |
| 5,458,950 | A | | 10/1995 | Bredenick et al. | 428/154 |
| 5,494,554 | A | | 2/1996 | Edwards et al. | |
| 5,503,896 | A | | 4/1996 | Veith et al. | |
| 5,529,563 | A | | 6/1996 | Veith et al. | |
| 5,562,805 | A | * | 10/1996 | Kamps et al. | 162/117 |
| 5,593,545 | A | * | 1/1997 | Rugowski et al. | 162/207 |
| 5,607,551 | A | | 3/1997 | Farrington, Jr. et al. | |
| 5,702,571 | A | * | 12/1997 | Kamps et al. | 162/117 |
| 5,743,999 | A | | 4/1998 | Kamps et al. | |
| 5,901,918 | A | * | 5/1999 | Klerelid et al. | 242/534 |
| 5,932,068 | A | * | 8/1999 | Farrington | 162/117 |
| 6,017,417 | A | | 1/2000 | Wendt et al. | |
| 6,030,496 | A | * | 2/2000 | Baggot et al. | 162/111 |
| 6,033,523 | A | | 3/2000 | Dwiggins et al. | |
| 6,077,590 | A | | 6/2000 | Archer et al. | |
| 6,080,276 | A | | 6/2000 | Burgess | |
| 6,146,499 | A | * | 11/2000 | Lin et al. | 162/197 |
| 6,171,442 | B1 | * | 1/2001 | Farrington, Jr. et al. | 162/129 |
| 6,231,719 | B1 | * | 5/2001 | Garvey et al. | 162/109 |
| 6,251,207 | B1 | | 6/2001 | Schultz et al. | |
| 6,302,998 | B1 | | 10/2001 | Burgess | |
| 6,306,482 | B1 | | 10/2001 | Ruppel et al. | |
| 6,344,111 | B1 | | 2/2002 | Wilhelm | |
| 6,440,268 | B1 | * | 8/2002 | Baggot et al. | 162/118 |
| 2003/0228444 | A1 | * | 12/2003 | Johnston et al. | 428/156 |
| 2004/0026052 | A1 | * | 2/2004 | Burazin et al. | 162/109 |

FOREIGN PATENT DOCUMENTS

| | | |
|---|---|---|
| EP | 0 113 958 A2 | 7/1984 |
| EP | 0 499 862 A1 | 8/1992 |
| EP | 0 566 775 B1 | 10/1993 |
| EP | 0 739 708 A2 | 10/1996 |
| WO | WO 00/38909 | 7/2000 |

OTHER PUBLICATIONS

Patent Abstracts of Japan 59091016 A: Description of Sedai Fumihiko et al., "Processing Of Synthetic Resin.".

* cited by examiner

*Primary Examiner*—José A. Fortuna
(74) *Attorney, Agent, or Firm*—Gregory E. Croft

(57) ABSTRACT

Uncreped throughdried tissue sheets are mechanically treated by calendering and embossing to provide a unique combination of desirable properties to the resulting sheet, which exhibits more surface uniformity, improved softness, high bulk and absorbency.

23 Claims, 8 Drawing Sheets

EMBOSSED UNCREPED THROUGHDRIED TISSUES

BACKGROUND OF THE INVENTION

In the manufacture of tissue products, such as bath tissue, uncreped throughdried products are now well known in the art and are commercially popular. A significant advantage of the uncreped throughdried process is the ability to make tissue sheets having high bulk and softness. The bulk of these sheets is largely due to the three-dimensional topography of the throughdrying fabrics used to produce them. This three-dimensional topography is molded into the tissue sheet during throughdrying and is tenaciously resilient, even under very high loads, due to the hydrogen bonding created during drying. While this property is very desirable in many respects, it does make subsequent modification of the sheet during the converting stage very difficult. The converting stage is generally understood to mean that portion of the total manufacturing process that occurs after the tissue sheet is formed and first rolled up into a parent roll. During converting, the sheet can be calendered and/or embossed, slit, rewound into smaller rolls and packaged for sale as bath tissue, paper towels and the like. The difficulty in modifying the sheet during converting arises particularly with respect to embossing, which typically does not readily provide permanent changes to the uncreped throughdried sheet because of its memory.

However, because of different consumer demands in various market segments, it is desirable to be able to alter the sheet properties during the converting stage of the manufacturing process. Therefore there is a need for a converting method which desirably alters the properties of the uncreped throughdried tissue sheet to produce unique tissue products.

SUMMARY OF THE INVENTION

It has now been discovered that desirable and permanent changes to the uncreped throughdried tissue basesheet can be made using a unique embossing process preceded by appropriate calendering, the combination of which essentially increases the visual and structural homogeneity of the basesheet. The resulting product possesses a unique structure and combination of properties. The embossing process includes embossing element geometry and special relationships that have been discovered to be effective in modifying the uncreped throughdried sheet topography.

Hence in one aspect, the invention resides in a method of mechanically manipulating an uncreped throughdried tissue sheet having bulky ripples oriented in the machine direction of the sheet, said method comprising:

(a) calendering the uncreped throughdried tissue sheet between a steel roll and a resilient backing roll; and (b) embossing the calendered sheet between engraved steel embossing rolls, each of said embossing rolls containing a plurality of male embossing elements having a base and a peak which are connected by inclined sidewalls, wherein the projected area of the element base is from about 0.03 to about 0.5 square millimeters, the surface area of the element peak is from about 0.02 to about 0.3 square millimeter, the height of the element is from about 0.5 to about 3 millimeters, the minimum element-to-element spacing is from about 0.3 to about 3 millimeters, the element pattern density is from about 15 to about 70 elements per square centimeter of embossing roll surface, wherein during operation the embossing rolls are positioned relative to each other such that element bases of one roll partially overlap element bases of the other roll and engage each other at a level of from about 25 to about 60 percent engagement, whereby the tissue sheet is pinched between portions of engaging elements such that it is strained in both the machine direction and the cross-machine direction of the sheet.

In another aspect, the invention resides in an embossed uncreped throughdried tissue sheet having a base structure characterized at least in part by a stylus contact profilometry "St" parameter (hereinafter defined) of about 1100 microns or less, more specifically about 1000 microns or less, still more specifically about 900 microns or less, still more specifically from about 700 to about 1100 microns, and still more specifically from about 700 to about 900 microns, and/or a stylus contact profilometry "Str" parameter (hereinafter defined) of about 0.300 or greater, more specifically from about 0.300 to about 0.700, still more specifically from about 0.300 to about 0.600, and still more specifically from about 0.300 to about 0.500.

The impact of the method of this invention on the St parameter of a sheet, which is a z-directional measure, will depend upon the basis weight, thickness and topography of the starting material. For paper towels, which tend to be heavier and thicker than bath tissues, for example, the St parameter will likely decrease as a result of the method of this invention. On the other hand, for bath tissues, which have a lighter and thinner starting material, the St parameter will likely increase. However, for any starting material, the Str parameter, which is a measure of the visual homogeneity of the surface of the sheet, will always increase as a result of the method of this invention. These structural changes to the topography of the sheet also result in a unique combination of other properties.

Hence, in another aspect, the invention resides in a roll of a tissue sheet, wherein said tissue sheet is an uncreped throughdried sheet having a stylus contact profilometry Str parameter of from about 0.300 or greater, a stylus contact profilometry St parameter of from about 1100 microns or less, a Void Volume of about 8 or more grams per gram and a Sheet Bulk of about 12 cubic centimeters or greater per gram, said roll having a Roll Bulk of about 13 cubic centimeters or greater per gram.

In another aspect, the invention resides in a stack of tissue sheets, wherein said sheets include uncreped throughdried sheets having a stylus contact profilometry Str parameter of from about 0.300 or greater, a stylus contact profilometry St parameter of from about 1100 microns or less, a Void Volume of about 8 or more grams per gram and a Sheet Bulk of about 12 cubic centimeters or greater per gram, said stack of sheets having a Stack Bulk of about 0.25 cubic centimeters or greater per gram.

These and other aspects of the invention will be described in greater detail below.

DESCRIPTION OF TEST METHODS

Figure 1A:
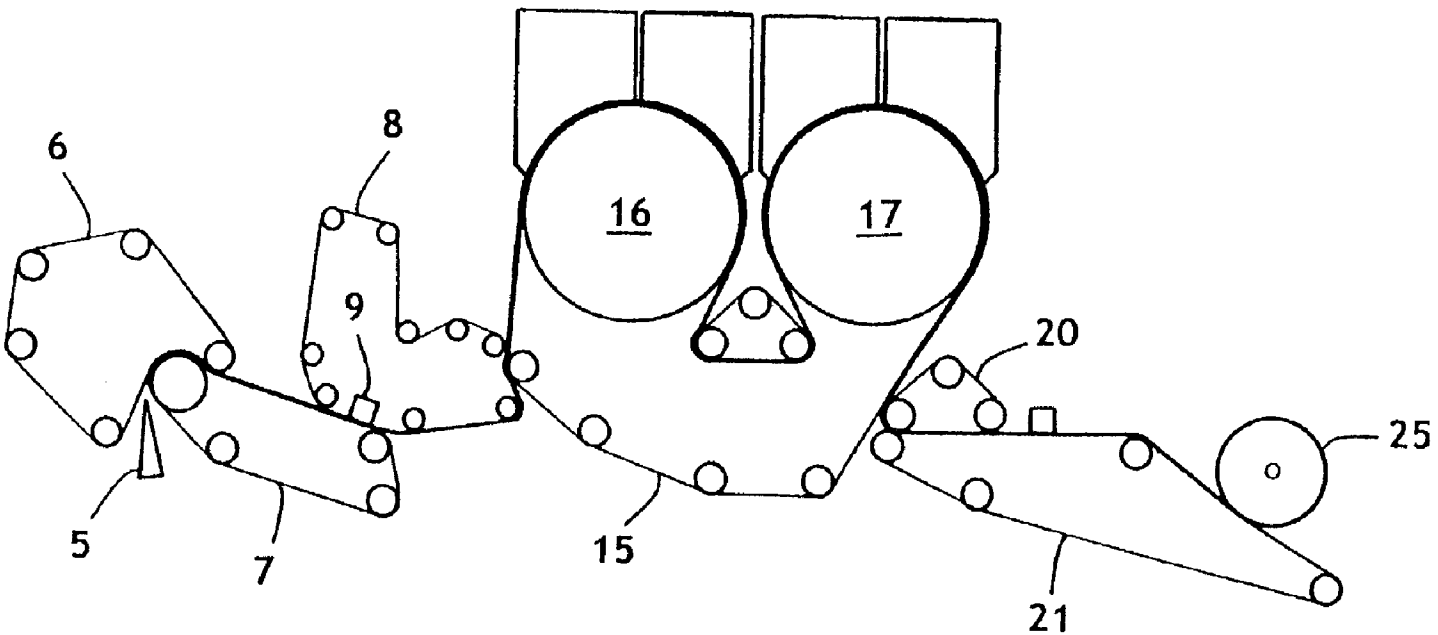
FIG. 1A is a schematic illustration of an uncreped throughdrying process suitable for making basesheets for purposes of this invention.

As used herein, "Void Volume" is a measure of the structural openness of the tissue sheet and is determined by saturating a sheet with a non-polar liquid and measuring the volume of the liquid absorbed. The specific procedure is described in U.S. Pat. No. 5,494,554 issued Feb. 27, 1996, to Edwards et al., which is hereby incorporated by reference. The sheets of this invention can have a Void Volume of about 8 grams per gram or greater, more specifically from about 8 to about 15 grams per gram, and still more specifically from about 10 to about 12 grams per gram.

As used herein, "Roll Bulk" is determined by measuring the volume of the roll product (excluding the core volume) and dividing the net product volume by its weight (excluding the core weight and the weight of any topical chemical add-on treatment). This procedure is more specifically described in U.S. Pat. No. 6,077,590 issued Jun. 20, 2000 to Archer et al., which is herein incorporated by reference. Rolls of sheets of this invention can have a Roll Bulk of about 10 cubic centimeters or greater per gram, more specifically about 12 cubic centimeters or greater per gram, and still more specifically from about 12 to about 15 cubic centimeters per gram.

As used herein, "Stack Bulk" is determined by measuring the bulk of a stack of sheets without external compression. The stack of sheets may or may not have been previously compressed, such as a stack of facial tissue sheets within a dispensing carton. In all cases, the measurement of Stack Bulk is taken without compression. More specifically, twenty (20) unfolded sheets are placed one on top of the other to form a stack of sheets. The volume of the stack, measured in cubic centimeters, is calculated by multiplying the length of the stack times the width of the stack times the height of the stack. The stack volume is divided by the weight of the stack (excluding the weight of any topical chemical add-on treatment), measured in grams, to yield the Stack Bulk, expressed as cubic centimeters per gram (cc/g). For purposes of this invention, the Stack Bulk can be about 0.25 cc/g or greater, more specifically from about 0.25 to about 0.45 cc/g, still more specifically from about 0.25 to about 0.40 cc/g., and still more specifically from about 0.30 to about 0.40 cc/g.

As used herein, "Sheet Bulk" is determined by dividing the "Caliper" of a single sheet (measured in centimeters) by its basis weight (measured in grams per square centimeter). The Caliper is measured in accordance with TAPPI test methods T402 "Standard Conditioning and Testing Atmosphere For Paper, Board, Pulp Handsheets and Related Products" and T411 om-89 "Thickness Caliper of Paper of Paper, Paperboard, and Combined Board". The micrometer can be an Emvico Model 200-A or equivalent, the Emvico Model 200-A micrometer having a 56.42 mm. diameter pressure foot, a pressure foot area of 2500 square mm., a load of 2.00 kPa, a dwell time of 3 seconds and a lowering rate of 0.8 mm/second. For purposes of this invention, the Sheet Bulk can be about 12 cc/g or greater, more specifically from about 12 to about 30 cc/g, and still more specifically from about 15 to about 25 cc/g.

The surface texture parameters "St" (Z-range envelope) and "Str" (surface texture aspect ratio) are used to quantify key topographic characteristics of the embossed tissue structure. "St" is the linear distance measured from the lowest valley to the highest peak contained in the topographic surface map, expressed in micrometers. "Str" is measured from the two-dimensional autocorrelation function (known as the a real autocorrelation function, AACF) derived from the surface topography and is the ratio of the minimum to the maximum radius of the central peak in the AACF. Autocorrelation is the mathematical operation specifying the degree of similarity in a surface or image between one position and some other. It is calculated by taking a topographic map and overlaying an exact duplicate translated by some offset in the horizontal and/or vertical direction. In the case of a topographic map, the xyz data points comprising the duplicate map are offset in all possible directions from the data points in the original map. The correlation between the original and offset maps is calculated and plotted against the x,y offset. The resultant map of correlations yields the a real autocorrelation function commonly known as the AACF. The central peak in the AACF has maximum intensity as it represents the maximum correlation (100% overlap) between the original and duplicate topographic maps. Analysis of the central peak in the AACF yields information about the isotropy of the surface topography and identifies any preferred structural orientation such as parallel peaks or valleys. By convention, prior to analysis the AACF is thresholded in the z-direction to the level where the magnitude of the autocorrelation function drops to 20%. For purposes of analysis, the minimum and maximum radii of the central peak at this threshold level are calculated and the ratio of the minimum radius to the maximum radius is defined as the surface texture ratio, Str. If the topographic structure of the surface is identical regardless of direction of measurement (isotropic), the central peak shape will be circular since the two radii will be equivalent and the value of Str will be the maximum value possible, 1. If the surface contains some structure having a preferred orientation such as parallel rows of peaks or valleys, the central peak shape will deviate from circularity and will tend to elongate parallel to that of the preferred structure orientation. In that case the calculated value of Str will also decrease since the ratio between the minimum and maximum radii of the central peak is decreased to some value less than 1 but greater than zero. Therefore, the more uniform or isotropic the surface topography becomes, Str will approach a value of 1. Conversely, as the surface topography has a more highly oriented structure, Str will approach a value of 0.

The analysis of surface texture using autocorrelation and measurement of Surface Texture Ratio is discussed, for example, in the text *The Image Processing Handbook*, Third Edition, J. C. Russ, ISBN 0-8493-2532-3, pp 727–735 and *Development of Methods for the Characterization of Roughness in Three Dimensions*, K. J. Stout, ed., ISBN 1 8571 8023 2, pp 180–185, 224–225, which is hereby incorporated by reference.

From the original topographic maps, the autocorrelation image and calculation of Str are accomplished using autocorrelation operators included in the analytical software, specifically *Form Talysurf Ultra, Series* 2 (Part No. K150-1036-02, Taylor Hobson Ltd., 2, New Star Road, Leicester, England LE4 9JQ).

The parameter St is measured from the topographic map of the tissue surface and is the linear distance in the vertical (z) direction between the lowest point in the map to the highest point in the map, expressed in micrometers. It thus encompasses all xyz data points contained within the map. It is the analogue of the parameter Rt for a 2-dimensional single line profile, but is extended to the three-dimensional surface which is comprised of a series of such profiles. It is obtained as a standard measurement parameter available for example, in *Form Talysurf Ultra, Series* 2.

Measurements for the Str and St parameters can be obtained using a Form Talysurf Laser Interferometric Stylus Profilometer (Taylor Hobson Ltd., 2, New Star Road, Leicester, England LE4 9JQ). The stylus used is Part #112/1836, diamond tip of nominal 2-micrometer radius. The stylus tip is drawn across the sample surface at a speed of 0.5 millimeters/sec. The vertical (Z) range is 6-millimeters, with vertical resolution of 10.0 nanometers over this range. Prior to data collection, the stylus is calibrated against a highly polished tungsten carbide steel ball standard of known radius (22.0008 mm) and finish (Part # 112/1844 [Taylor Hobson Ltd.]. During measurement, the vertical position of the tip is detected by a helium/neon laser interferometer pick-up, Part # 112/2033. Data is collected and processed using *Form Talysurf Ultra Series* 2 software running on an IBM PC compatible computer.

To measure the Strand St parameters for a particular tissue sample, a portion of the tissue is removed with a single-edge razor or scissors (to avoid stretching the tissue) from a position near the center of the sheet (to avoid edge curl or other damage). The tissue is attached to the surface of a 2"×3" glass slide using double-side tape and lightly pressed into uniform contact with the tape using another slide. The slide is placed on the electrically operated, programmable Y-axis stage of the Profilometer. For purposes of measuring the surface, the Profilometer is programmed to collect a "3D" topographic map, produced by automatically datalogging 256 sequential profile traces in the stylus traverse direction (X-axis), each 15 millimeters in length. The Y-axis stage is programmed to move in 58.6 micrometer increments after each traverse is completed and before the next traverse occurs, providing a total Y-axis measurement dimension of 15 millimeters and a total mapped area measuring 15×15 millimeters. With this arrangement, data points each spaced 58.6 micrometers apart in both axes are collected, giving the maximum total 65,536 data points per map available with this system. The resultant "3D" topological map, being configured as a ".SUR" computer file consisting of X-, Y- and Z-axis spatial data (elevation map), is then reconstructed for analysis as described above using Talymap 3D ver. 2.02 software Part # B112/2910 [Taylor Hobson Ltd.] running on an IBM PC compatible computer.

As used herein, the term "uncreped" refers to a paper sheet that has not been creped (violently dislodged from a drying cylinder by a high angle (greater than 45°) direct impact with a creping blade surface that results in buckling and debonding of the sheet), but includes sheets that have been minimally structurally disrupted during removal from a drying surface, such as by peeling or doctoring.

DETAILED DESCRIPTION OF THE DRAWINGS

Referring to the Figures, the invention will be described in greater detail.

FIG. 1A is a schematic illustration of an uncreped throughdried tissue making process suitable for purposes of making basesheets to be further mechanically treated in accordance with this invention. In particular, shown is an uncreped through-air-dried tissuemaking process in which a multi-layered headbox 5 deposits an aqueous suspension of papermaking fibers between forming wires 6 and 7. The newly-formed web is transferred to a slower moving transfer fabric with the aid of a vacuum box 9. The web is then transferred to a throughdrying fabric 15 and passed over throughdryers 16 and 17 to dry the web. After drying, the web is transferred from the throughdrying fabric to fabric 20 and thereafter briefly sandwiched between fabrics 20 and 21. The dried web remains with fabric 21 until it is wound up into a parent roll 25.

Figure 1B:
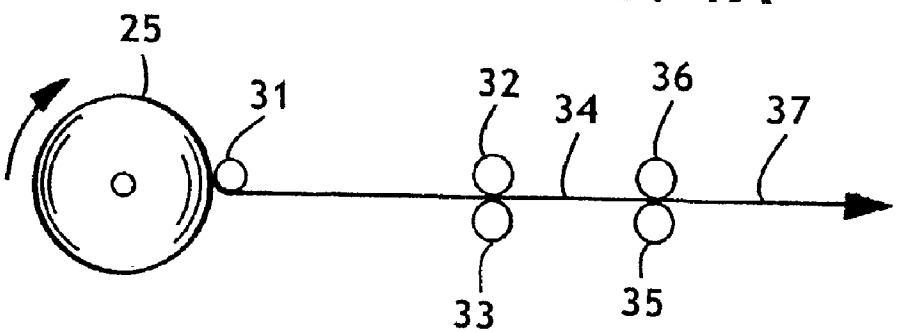
FIG. 1B is a schematic illustration of the converting treatment of the basesheet in accordance with this invention.

FIG. 1B is a schematic illustration of the converting treatment of the basesheet in accordance with this invention. Shown is the uncreped throughdried basesheet being unwound from the parent roll 25 and being guided by roll 31 to the nip between rubber calender roll 32 and steel calender roll 33. The hardness of the rubber calendering roll can be from about 4 to about 60 P&J hardness or greater. Relatively hard surfaces are advantageous. A particularly suitable hardness is about 4 P&J. The nip pressure can be from about 250 N/cm$^2$ to about 500 N/cm$^2$ (50–200 pounds-force per lineal inch). The resulting calendered sheet is then embossed between steel calender rolls 35 and 36 in a manner more fully describe below. The resulting embossed sheet 37 is then further converted to the final product form, such as bath tissue, facial tissue and paper towels, in a conventional manner.

Figure 2:
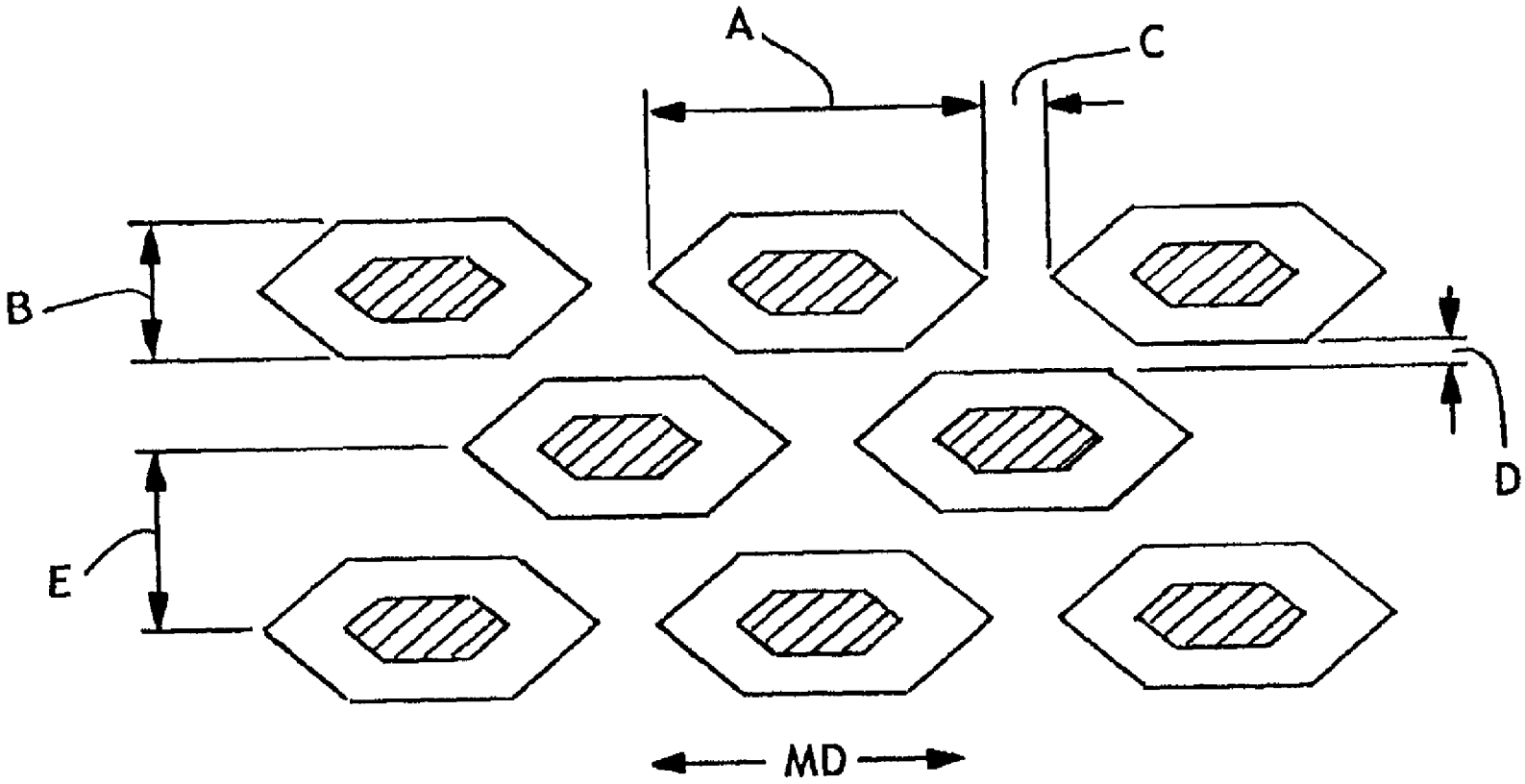
FIG. 2 is a plan view of engraved male embossing elements suitable for purposes of this invention, illustrating an example of the shape and spacing of the elements.

FIG. 2 is a plan view of an embossing element pattern suitable for purposes of this invention. In this particular pattern, each of the elements is an elongated hexagon arranged in alternating staggered rows. Each element of every row is centered on the space between the closest elements in the two adjacent rows. Each element has a base, which is defined by the outermost line of the element. Each element also has a peak, which is defined by the shaded area. The white area between the outermost line of the element and the peak represents the inclined sidewall that connects the base with the peak.

The element pattern density on the surface of each embossing roll can be from about 15 to about 70 elements per square inch, more specifically from about 20 to about 55 elements per square inch, and more specifically from about 20 to about 40 elements per square inch.

The general size of each element, which is represented by the projected area of the element base, can be from about 0.03 to about 0.5 square millimeters (mm$^2$), more specifically from about 0.04 to about 0.4 mm$^2$, and still more specifically from about 0.06 to about 0.25 mm$^2$.

The surface area of the peak, as represented by the shaded area, can be from about 0.02 to about 0.3 mm$^2$, more specifically from about 0.025 to about 0.25 mm$^2$, and still more specifically from about 0.04 to about 0.15 mm$^2$.

The length of each element, as measured in the machine direction and designated by dimension "A" in FIG. 2, can be from about 0.3 to about 8 mm, more specifically from about 1 to about 6 mm, and still more specifically from about 2 to about 3 mm.

The width of each element, as measured in the cross-machine direction and designated by dimension "B" in FIG. 2, can be from about 0.3 to about 8 mm, more specifically from about 1 to about 6 mm, and still more specifically from about 2 to about 3 mm.

The machine direction spacing between each element in its row, designated as dimension "C" in FIG. 2, can be from about 0.5 to about 12 mm, more specifically from about 1 to about 10 mm., and still more specifically from about 1 to about 5 mm.

The cross-machine direction spacing between adjacent rows, designated as dimension "D" in FIG. 2, can be from about 0.3 to about 3 mm, more specifically from about 0.4 to about 2.5 mm., and still more specifically from about 0.5 to about 2 mm.

The cross-machine direction center-to-center spacing between elements in adjacent rows, designated as dimension "E" in FIG. 2, can be from about 0.5 to about 6 mm, more specifically from about 0.8 to about 5 mm, and still more specifically from about 1.0 to about 4 mm.

Specific dimensions for the elements illustrated in FIG. 2 and which have been found to be suitable for purposes of carrying out the invention are as follows: the length of each element (in the machine direction) is 2.54 mm; the width of each element is 1.27 mm; the machine direction spacing of each element in its row is 1.0 mm; the cross-machine direction spacing between the rows is 0.51 mm; and the cross-machine direction center-to-center spacing between rows is 2.0 mm.

While hexagonal elements are specifically illustrated, other element shapes can also be used. However, the size and spacing of the elements must be such that elements from each embossing roll can engage each other, at least partially, by penetrating the space between elements of the other embossing roll to create a pinch area between inclined sidewalls of the engaging elements. This will be more clearly illustrated in FIG. 4, discussed below.

Figure 3:
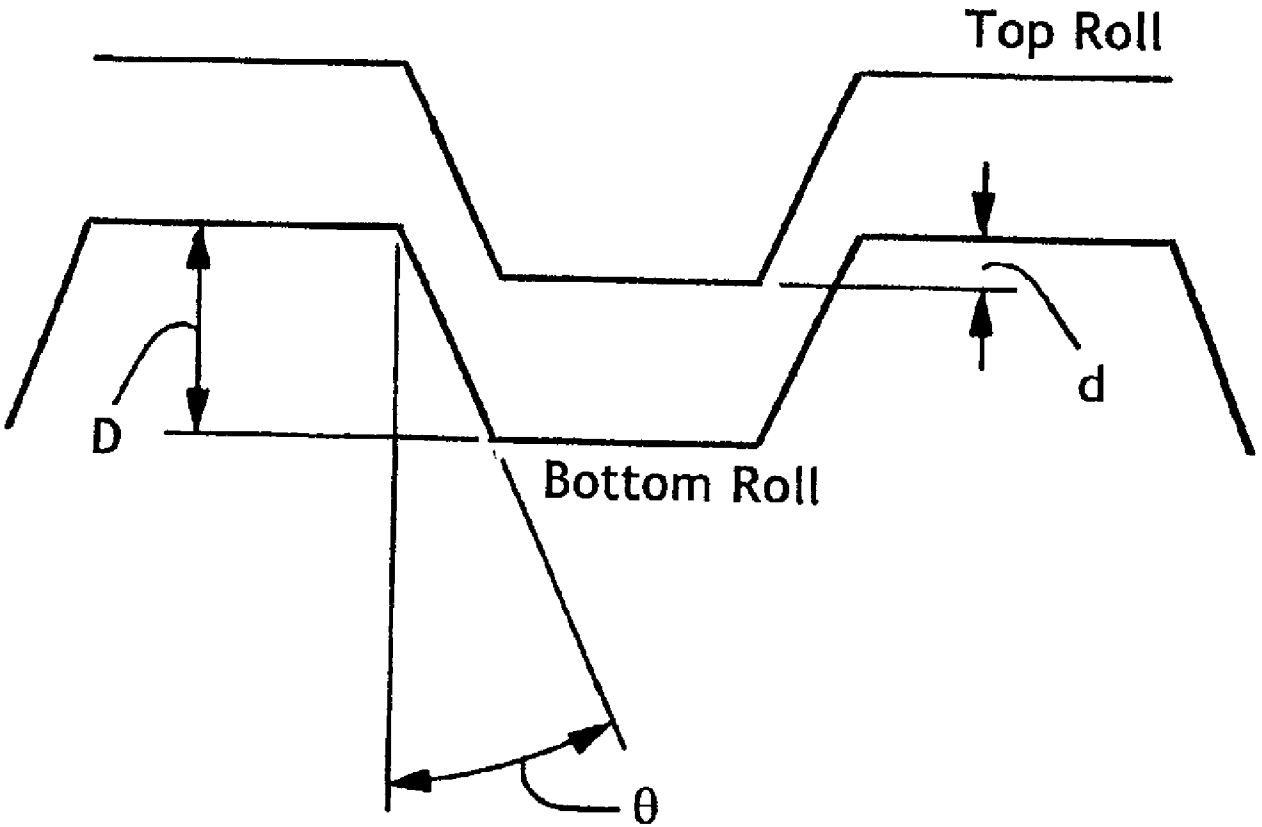
FIG. 3 is a schematic sectional view of engaged embossing elements in accordance with this invention, further illustrating an example of the shape of the elements and the concept of engagement.

FIG. 3 schematically illustrates the concept of element engagement. Shown is an element on a first embossing roll penetrating the space between two elements on the other mating embossing roll. The height of each element, sometimes referred to as the depth, is represented by the dimension "D". The dimension "d" represents the distance the two elements are engaged. This is the distance by which the peak of one element passes the peak of the other. Expressed as a percentage of the height "D", this is the percent engagement. Also shown is the inclined sidewall connecting the base and the peak of the element. The angle "θ" is the angle of incline of the sidewall.

For purposes of this invention, the height of the element can be from about 0.5 to about 3 mm, more specifically from about 1.0 to about 2.5 mm, and still more specifically from about 1.2 to about 2.0 mm. A particularly suitable element height is about 1.6 mm.

The angle of incline of the sidewall can be from about 10 to about 30 degrees, more specifically from about 10 to about 25 degrees, and still more specifically from about 10 to about 20 degrees. A particularly suitable angle of incline is about 20 degrees.

The percent engagement can be from about 25 to about 60 percent, still more specifically from about 30 to about 55 percent, and still more specifically from about 40 to about 50 percent. A particularly suitable percent engagement is about 50 percent.

Figure 4B:
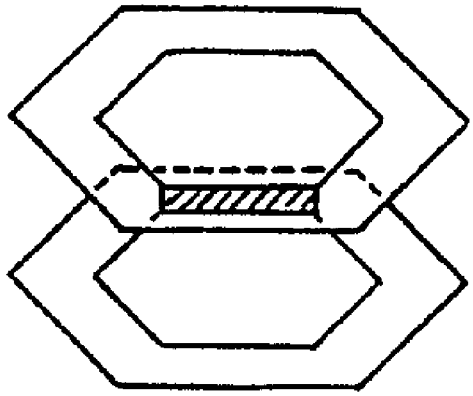
FIGS. 4A and 4B are schematic plan view of the diagonal positioning of engaged, overlapping elements in accordance with this invention (4A) and machine direction positioning (4B), illustrating the area in which the sheet is pinched to provide a permanent embossing pattern.
Figure 4A:
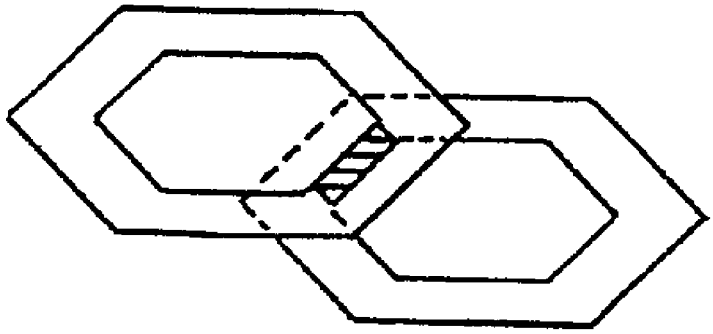

FIGS. 4A and 4B schematically show the overlaid position of two engaging elements, one element from each of the two embossing rolls. The configuration of FIG. 4A is referred to as "diagonal" alignment because the two engaging elements create a pinch area that is diagonal to the MD direction. The configuration of FIG. 4B is referred to as "machine direction" alignment because the pinch area aligns in the machine directions. For purposes of illustration, element 41 is the top element and element 42 is the bottom element. The cross-hatched area represents the pinch area between the two elements. The distance between the elements in the pinch area is about 10 percent or less of the thickness of the tissue sheet being embossed. As used in this sense, the "thickness" of the sheet is the uncompressed peak-to-peak distance from one side of the sheet to the other. As such, thickness takes into account the undulations in the sheet.

Figure 5A:
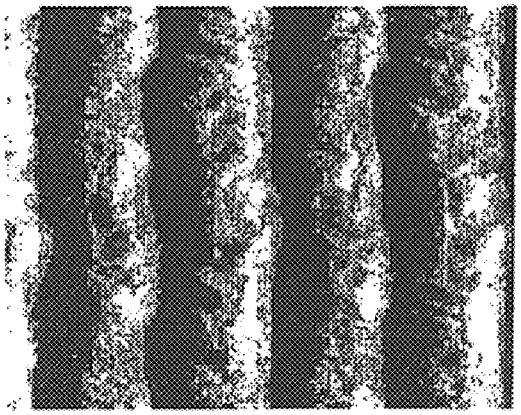
FIGS. 5A and 5B are plan view photographs of an uncreped throughdried tissue basesheet (5A) and a tissue sheet in accordance with this invention (5B).

FIG. 5A is a plan view photograph with a field of view of 10×15 mm, showing an uncreped throughdried basesheet prior to the mechanical treatment of this invention. Clearly shown are the bulky ripples running in the machine direction of the sheet.

Figure 5B:
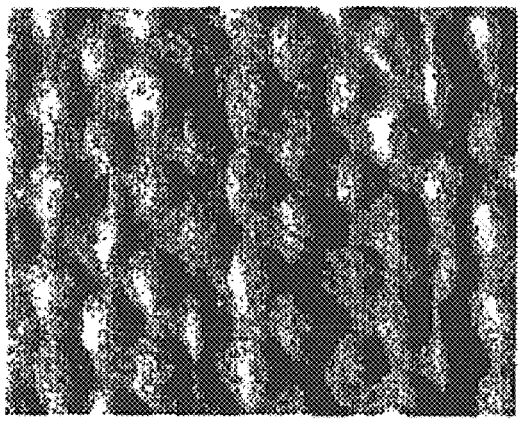

FIG. 5B is the same sheet treated in accordance with this invention. The bulky ridges are effectively masked, even though the resulting sheet has significant bulk.

Figure 6:
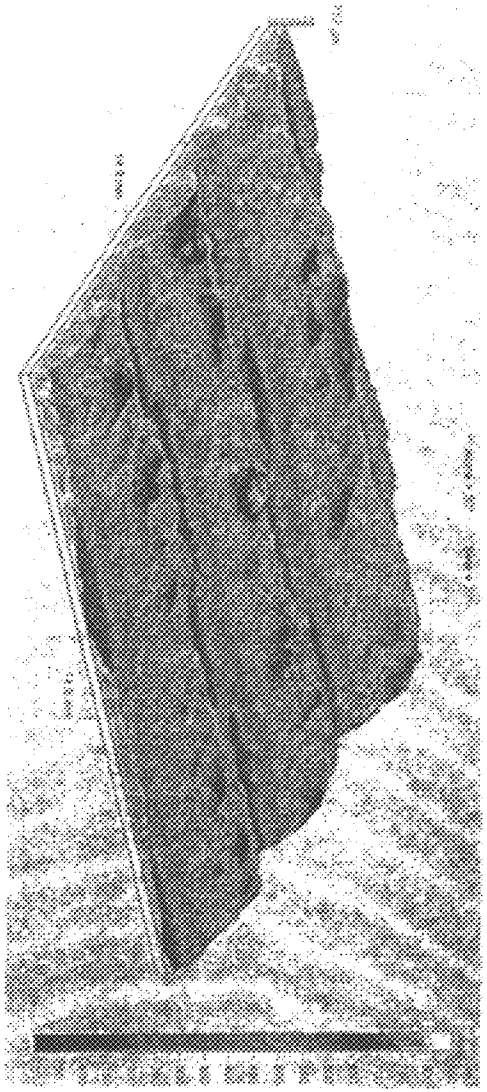
FIG. 6 is 3-dimensional topographical map of an uncreped throughdried paper towel (control) which has not been embossed in accordance with this invention.

FIG. 6 is 3-dimensional topographical map of an uncreped throughdried paper towel (control) which has not been mechanically treated in accordance with this invention. Shown are three of the characteristic machine direction ripples of the basesheet.

Figure 7:
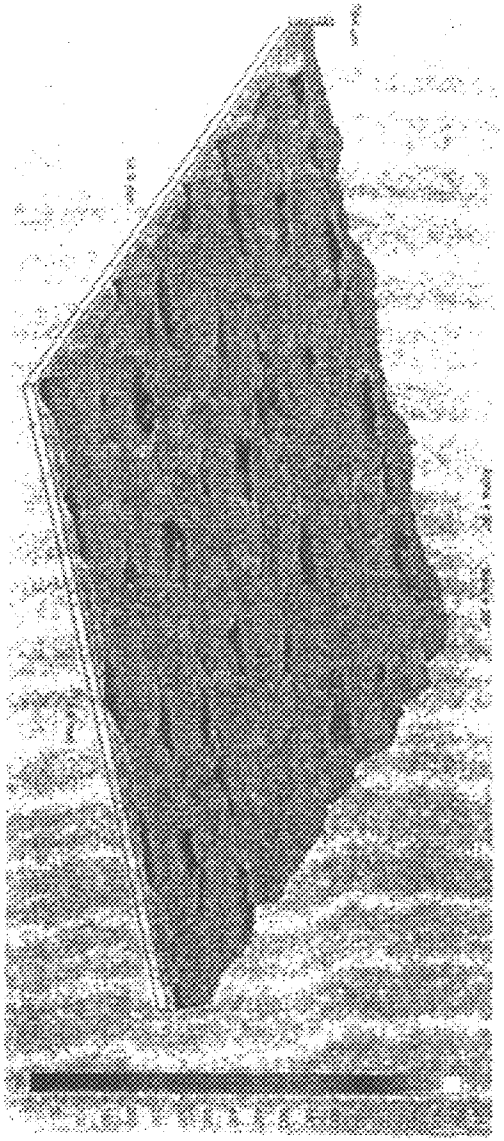
FIG. 7 is 3-dimensional topographical map of an uncreped throughdried paper towel which has been embossed in accordance with this invention.

FIG. 7 is 3-dimensional topographical map of an uncreped throughdried paper towel which has been mechanically treated in accordance with this invention. As shown, the machine direction ripples have effectively been eliminated or modified such that they are not readily apparent.

Figure 8:
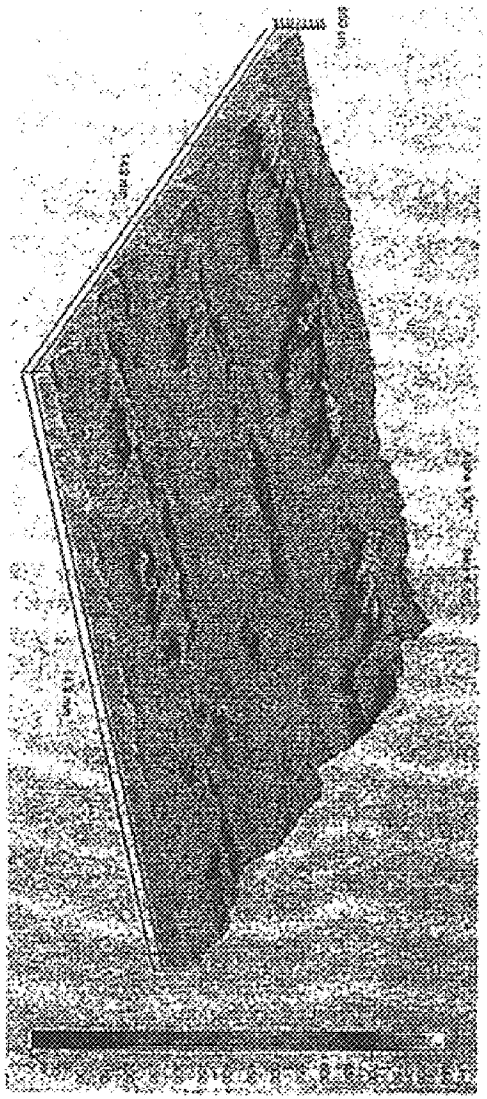
FIG. 8 is 3-dimensional topographical map of another uncreped throughdried paper towel which has been embossed in accordance with this invention.

FIG. 8 is 3-dimensional topographical map of another uncreped throughdried paper towel which has been mechanically treated in accordance with this invention, but the effect of the treatment is less than that illustrated in FIG. 7.

EXAMPLES

Example 1

A three-layered tissue in accordance with this invention was made as described in FIG. 1. The furnish for the two outer layers consisted of 75% eucalyptus fibers/25% broke which had been previously treated with a softening agent. In particular, the eucalyptus/broke fibers were dispersed in a hydrapulper and, after pulping, the slurried furnish was transferred to a stock chest and treated with an immidazoline softening agent, ProSoft TQ 1003 from Hercules, Inc., added at a dosage of 4.0 Kg/Tonne of active chemical per metric ton of fiber under good mixing conditions. After 20 minutes of mixing time, the slurry was dewatered using a belt press to approximately 32% consistency. Because this particular chemical addition method removes most non-retained softening agent from the water phase prior to tissue forming, the resultant product can be produced with exceptionally good strength. The thickened stock was placed in a high-density storage chest until needed during tissue manufacturing.

To form the tissue, a three-layered headbox was employed, through which the two outer layers contained the same treated eucalyptus/broke fibers described above and the center layer contained 100% refined softwood fibers. The softwood was refined to 4.0 horsepower-days/metric tonne to attain an average basesheet geometric mean tensile of 1685 g/3 inches. A bonding agent, Parez 631-NC which is commercially available from Cytec Industries, Inc. was employed at a rate of 3.0 Kg/Tonne (based on bone-dry weight of center layer). The resulting three-layered sheet structure was formed on a twin-wire, suction form roll. The speed of the forming fabric was 2048 feet per minute (fpm). The newly-formed web was then dewatered to a consistency of about 20–27% using vacuum suction from below the forming fabric before being transferred to the transfer fabric, which was traveling at 1600 fpm (28% rush transfer). A vacuum shoe pulling about 9–10 inches of mercury vacuum was used to transfer the web to the transfer fabric. A second vacuum shoe pulling about 5–6 inches of mercury vacuum was used to transfer the web to a t1203-1 throughdrying fabric manufactured by Voith Fabrics Inc. The web was carried over a pair of Honeycomb throughdryers operating at temperatures of about 375° F. and dried to a final dryness of about 97–99% consistency. The dried cellulosic web was rolled onto a core to form a parent roll of tissue.

The parent roll tissue was then converting into soft, bulky rolls of bath tissue by the means of this invention which include passing the tissue through a soft nip calender consisting of a rubber roll of 4 P&J hardness mated against a smooth steel roll loaded to 150 pli (pounds per lineal inch) sustainable nip pressure. The calendered tissue web was then sent through a matched steel embosser where an embossing pattern of small, hexagonal pyramids with radiused edge elements having a pattern density of 7 elements per linear inch, an element depth of 0.0634 inches, and a side-wall angle of 10 degrees with adequate room between elements for mating with the complementary engraved roll, was engaged to 50% of the total pattern depth or had an element overlap of 0.032 inches between elements on the top and bottom rolls. Finished bath tissue rolls were wound to have 300 sheets per roll.

Example 2

Control

Basesheet was made in a similar fashion as in Example 1 except that the softwood was refined to 0.9 HPD/Tonne and Parez 631-NC was added at a rate of 3.0 Kg/Tonne (based on bone-dry weight of center layer). This resulted in a lower strength basesheet than that explained in Example 1 (target geometric mean tensile strength (GMT) for basesheet in Example 1=1700 g, Example 2=900 g).

The basesheet made according to this example was converted into finished bath product rolls by passing the web through a 4 P&J against steel roll calender nip loaded to 70 pounds per lineal inch sustainable pressure. After calendering, the web was wound into 400 sheet count finished product rolls. This non-embossed product can be used as a control when compared to the embossed product discussed in Example 1 as both finished products had a geometric mean tensile strength of about 700 g.

Example 3

A tissue was made as described in Example 1, except the tissue was passed through a soft nip calender of 4 P&J hardness mated against a smooth steel roll loaded to 90 pli (pounds per lineal inch) sustainable nip pressure. The sheet was then passed through the matched steel embosser with dimensions as described in Example 1 but engaged to 42% of the total pattern depth or had an element overlap of 0.027 inches between elements on the top and bottom rolls.

A summary of the resulting bath tissue product rolls from Examples 1–3, made at 300 fpm, had the properties shown in Table 1 below.

TABLE 1

| | GMT (g) | Roll Bulk (cc/g) | Sheet Bulk (cc/g) | Void Volume (g/g) | St (μm) | Str |
|---|---|---|---|---|---|---|
| Control (Ex. 2) | 747 | 9.5 | 11.5 | 8.6 | 777 | 0.281 |
| Invention (Ex. 1) | 747 | 13.1 | 19.6 | 10 | 764 | 0.389 |
| Invention (Ex. 3) | 729 | 11.0 | 15.3 | 8.2 | 850 | 0.365 |

Example 4

Basesheet was made in a similar fashion as Example 1 except that the softwood was refined to 3.8 HPD/Tonne and Parez 631-NC was added at a rate of 2.0 Kg/Tonne (based on bone-dry weight of center layer).

This basesheet was converted in two different ways in order to compare the embossed product of this invention to a non-embossed control product made from the same basesheet. The product of this invention was converted with the same method as described in Example 1. The control product was converted with the same method as described in Example 3. The nature of the method of this invention results in higher sheet degradation than the control, therefore the geometric mean tensile strength for the product of this invention is lower when using the same basesheet as this example describes.

Table 2 shows some key physical property data for both the control and invention samples for this example.

TABLE 2

| | GMT (g) | Roll Bulk (cc/g) | Void Volume (g/g) | Sheet Bulk (cc/g) | St | Str |
|---|---|---|---|---|---|---|
| Control (Ex. 4) | 1260 | 9.1 | 7.6 | 11.6 | 779 | 0.28 |
| Invention (Ex. 4) | 680 | 12.2 | 10.1 | 18.0 | 763 | 0.39 |

It will be appreciated that the foregoing Examples, given for purposes of illustration, are not to be construed as limiting the scope of this invention, which is defined by the following claims and all equivalents thereto.

We claim:

1. An embossed uncreped throughdried tissue sheet having a stylus contact profilometry Str parameter of about 0.3 or greater.

2. The tissue sheet of claim 1 wherein the Str parameter is from about 0.3 to about 0.7.

3. The tissue sheet of claim 1 wherein the Str parameter is from about 0.300 to about 0.600.

4. The tissue sheet of claim 1 wherein the Str parameter is from about 0.300 to about 0.500.

5. The tissue sheet of claim 1 further having a stylus contact profilometry St parameter of about 1100 microns or less.

6. The tissue sheet of claim 1 further having a stylus contact profilometry St parameter of about 1000 microns or less.

7. The tissue, sheet of claim 1 further having a stylus contact profilometry St parameter of about 900 microns or less.

8. The tissue sheet of claim 1 further having a stylus contact profilometry St parameter of from about 700 to about 1100 microns.

9. The tissue sheet of claim 1 further having a stylus contact profilometry St parameter of from about 700 to about 900 microns.

10. The tissue sheet of claim 1 having a Sheet Bulk of about 12 cubic centimeters or greater per gram.

11. The tissue sheet of claim 1 having a Sheet Bulk of from about 12 to about 30 cubic centimeters per gram.

12. The tissue sheet or claim 1 having a Sheet Bulk of from about 15 to about 25 cubic centimeters per gram.

13. The tissue sheet of claim 1 having a Void Volume of about 8 or more grams per gram.

14. The tissue sheet of claim 1 having a Void Volume of from about 8 to about 15 grams per gram.

15. An uncreped tissue sheet having a stylus contact profilometry Str parameter of from about 0.300 to about 0.700, a stylus contact profilometry St parameter of from about 700 to about 1100 microns, a Void Volume of about 8 or more grams per gram and a Sheet Bulk of about 12 cubic centimeters or greater per gram.

16. The tissue sheet of claim 15 having a Void Volume of from about 8 to about 15 grams per gram and a Sheet Bulk of from about 15 to about 25 cubic centimeters per gram.

17. A roll of a tissue sheet, wherein said tissue sheet is an uncreped throughdried sheet having a stylus contact profilometry Str parameter of from about 0.300 or greater, a stylus contact profilometry St parameter of from about 1100 microns or less, a Void Volume of about 8 or more grams per gram and a Sheet Bulk of about 12 cubic centimeters or greater per gram, said roll having a Roll Bulk of about 13 cubic centimeters or greater per gram.

18. The roll of claim 17 having a Roll Bulk of about 12 cubic centimeters or greater per gram.

19. The roil of claim 17 having a Roll Bulk of from about 12 to about 18 cubic centimeters per gram.

20. A stack of tissue sheets, wherein said sheets include uncreped throughdried sheets having a stylus contact profilometry Str parameter of from about 0.300 or greater, a stylus contact profilometry St parameter of from about 1100 microns or less, a Void Volume of about 8 or more grams per gram and a Sheet Bulk of about 12 cubic centimeters or greater per gram, said stack of sheets having a Stack Bulk of about 0.28 cubic centimeters or greater per gram.

21. The stack of tissue sheets of claim 20 wherein the Stack Bulk is from about 0.28 to about 0.45 cubic centimeters per gram.

22. The stack of tissue sheets of claim 20 wherein the Stack Bulk is from about 0.28 to about 0.40 cubic centimeters per gram.

23. The stack of tissue sheets of claim 20 wherein the Stack Bulk is from about 0.30 to about 0.40 cubic centimeters per gram.

* * * * *